United States Patent [19]

Freitag

[11] Patent Number: 4,931,241

[45] Date of Patent: Jun. 5, 1990

[54] METHOD FOR PRODUCING STRUCTURES BY ISOSTATIC COMPRESSION

[75] Inventor: Douglas W. Freitag, Arlington, Tex.

[73] Assignee: LTV Aerospace and Defense Company, Dallas, Tex.

[21] Appl. No.: 82,431

[22] Filed: Aug. 6, 1987

[51] Int. Cl.[5] ..... B28B 1/26; B28B 7/06

[52] U.S. Cl. ..... 264/86; 264/87; 264/570; 264/313; 425/84; 425/85; 425/405.1

[58] Field of Search ..... 264/86, 87, 56, 570, 264/571, 313, 314, 315, 101, 102; 425/84, 85, 405.1, 405.2

[56] References Cited

U.S. PATENT DOCUMENTS

| | | | |
|---|---|---|---|
| 1,846,279 | 2/1932 | Speirs | 425/85 |
| 1,863,854 | 6/1932 | Jeffery | 264/102 |
| 2,311,588 | 2/1943 | Denning | 264/56 |
| 2,342,801 | 2/1944 | Guerci | 264/86 |
| 3,577,635 | 5/1971 | Bergman et al. . | |
| 3,833,389 | 9/1974 | Komeya et al. . | |
| 4,203,936 | 5/1980 | Kiwak et al. | 264/120 |
| 4,507,224 | 3/1985 | Toibana et al. . | |
| 4,543,345 | 9/1985 | Wei . | |
| 4,560,668 | 12/1985 | Hunold et al. . | |
| 4,596,781 | 6/1986 | Carpenter . | |
| 4,612,163 | 9/1986 | Nishio et al. . | |
| 4,652,413 | 3/1987 | Tiegs . | |
| 4,702,870 | 10/1987 | Setterholm et al. | 264/87 |

FOREIGN PATENT DOCUMENTS

| | | | |
|---|---|---|---|
| 0054680 | 3/1984 | Japan | 501/95 |
| 0719498 | 12/1954 | United Kingdom | 264/86 |

OTHER PUBLICATIONS

Kirk-Othmer, Encyclopedia of Chemical Technology, 3rd Edition, John Wiley & Sons, 1979, Refractory Matrix Powders, vol. 6, "Composite Materials", pp. 683-700.

Kirk-Othmer, Encyclopedia of Chemical Technology, 3rd Edition, John Wiley & Sons, 1979, vol. 19, "Powder Metallurgy", pp. 28-46.

*Primary Examiner*—Jan H. Silbaugh
*Assistant Examiner*—MaryLynn Fertig
*Attorney, Agent, or Firm*—James M. Cate; Stephen S. Sadacca; William D. Jackson

[57] ABSTRACT

A process for producing a green composite structure by isostatic compression and filtration. A suspension of colloidal size matrix powders is established in a carrier liquid. The suspension is incorporated into a die chamber having a filter opening containing a filter which is permeable to filtrate from the suspension under applied pressure but substantially impermeable to the matrix powders. An elevated pressure is isostatically imposed on the colloidal suspension within the die chamber. The pressure is maintained for a period of time to expel at least 20% of the liquid originally in the colloidal suspension through the filter opening. A specific die chamber comprises a rigid cage structure and an expandable bladder within the cage structure into which the colloidal suspension is introduced. The cage structure is disposed within a pressure vessel which can be initially evacuated to cause the bladder to conform to the cage structure and then pressurized with fluid for the isostatic compression procedure.

25 Claims, 3 Drawing Sheets

METHOD FOR PRODUCING STRUCTURES BY ISOSTATIC COMPRESSION

TECHNICAL FIELD

This invention relates to the formation of products from colloidal matrix powders by isostatic compression and filtration and more particularly to a method and apparatus for forming filament reinforced ceramic composites in desirable configurations by the shaping and filtration of the composite components in liquid suspension under isostatic pressure.

ART BACKGROUND

There are various procedures known in the prior art for the preparation of refractory composite structures which are resistant to degradation through oxidation or applied thermal and mechanical stresses or under severe temperature conditions. Such refractory structures can incorporate the use of metal powders such as those used in powder metallurgy processes, ceramic powders and mixtures of ceramic and metal powders commonly referred to as ceramals and cermets. Such products are employed in high temperature environments up to 3000° F. and even beyond as components in turbine engines and heat exchangers. They are also used in low temperature structures requiring characteristics such as high strength/weight ratios, high corrosion resistance, high erosion resistance, and high dielectric capacities. Such materials find uses in the electronics industry and in various bearing applications.

Procedures using in forming high performance structures include isostatic pressing, uniaxial pressing, injection molding, and slip casting procedures. The isostatic and uniaxial pressing procedures may be carried out as "hot" or "cold" procedures. In the former, the pressing operation is carried out at high temperatures, in some cases under sintering conditions, requiring the use of extremely high pressure, high temperature autoclave equipment. In most shaping operations, the composite components are shaped and pressed in a dry powder form. In slip casting, however, a dispersion of the particulate components, sometimes but not always in the colloidal size range, is formed in a thickened liquid suspension, termed a "slip". The slip is then incorporated into a plaster of paris mold and the liquid in the suspension is extracted from the slip by capillary absorption into the interstitial pore spaces of the mold. Pressure assisted slip casting may be employed in which additional pressure is imposed upon the slip within the mold to force the fluid medium into the surrounding mold structure.

Various materials may be employed in producing ceramic composite structures. A conventional approach is to incorporate reinforcing filaments into a particulate matrix material of matrix powders which may include one or more ceramic materials. For example, U.S. Pat. No. 4,543,345 to Wei discloses a refractory composite and its method of preparation in which monocrystalline silicon carbide whiskers are used to reinforce the composite material based upon ceramic matrix powders such as $Al_2O_3$, $3Al_2O_3.2SiO_2$, and $B_4C$. The silicon carbide whiskers are characterized as having an average diameter of 0.6 microns, a length of 10–80 microns, and an average aspect ratio (the ratio of whisker length to whisker diameter) of 75.

Wei discloses two general procedures for forming the composite. The first, to produce a product in which the whisker orientation is in a plane orthagonal to a pressing axis, is exemplified by the procedure in which fine ceramic powders (0.5–1.0 micron) and silicon carbide whiskers are mixed in hexane and then agitated in a blender followed by dispersion in an ultrasonic homogenizer. The resulting mixture is dried and then hot pressed to a density of more than 99% of theoretical density. Hot pressing is carried out at temperatures of 1600 to 1950° C. and pressures of 28–70 MPa. An alternative to the use of hexane as a solvent in this procedure is distilled water which is removed by freeze drying prior to the hot pressing step. An alternative procedure designed to achieve omnidirectional whisker orientation involves isostatic hot pressing. Here the pressures and temperatures applied to the mixture in a tantalum can in a high temperature inert-gas autoclave are in the same ranges as those employed in the uniaxial pressing procedure.

U.S. Pat. No. 4,560,668 to Hunold et al discloses the production of shaped composites based upon mixtures of polycrystalline silicon nitride and polycrystalline silicon carbide powders having particle sizes up to 10 microns. The particulate mixture is mixed with a temporary binder and dispersed in a solution of a solvent such as acetone or a $C_1$–$C_6$ aliphatic alcohol and then shaped by known techniques such as die pressing, isostatic pressing, injection molding, extrusion molding or slip casting. After the shaping procedure, which is carried out at room temperature or above, the shaped green composite is heated to a temperature from 300 to 1200° C. prior to an encapsulated isostatic hot pressing procedure. The thermotreatment is employed in order to ensure that gaseous decomposition products from the binders do not interfere or damage the casing employed in the hot isostatic pressing process. The composite materials, enclosed within a suitable casing such as tungsten, glass, etc., are heated in a high pressure autoclave at temperatures within the range of 1800–2200° C. at pressures of from 100 to 400 MPa.

Isostatic compression has long been used in the manufacture of shaped ceramic structures. For example, U.S. Pat. No. 3,577,635 to Bergman discloses an isostatic compression process in which a powder body, e.g., a spiral heating element billet, is disposed in an inner container filled with a pressure medium such as glycerin which in turn is placed within an outer pressure chamber filled with a hydraulic oil. The bottom of the inner, glycerin-filled container is provided with an elastomeric flexible membrane which encloses a compression space at least as large as the decrease in total space taking place within the inner chamber. Alternatively, the bottom of the inner container may be provided with a movable cylinder. In either case the pressure is increased to a suitable value, for example 6000 atmospheres, in order to isostaticly compress the object within the inner container.

U.S. Pat. No. 4,612,163 to Nishio et al discloses a cold isostatic pressing process characterized as being of the "wet bag" type in which an elastic bag is placed in the cavity of a permeable mold support. The mold support is placed within a container which is evacuated in order to produce a vacuum and cause the elastic bag to conform to the walls of the mold cavity. The bag is then filled with suitable composite particulates and placed within a cold isostatic pressing unit where pressures of from 2000–4000 atmospheres are imposed. The resulting molding then may be subject to sintering.

U.S. Pat. No. 4,596,781 to Carpenter disclose a procedure for producing a silicon nitride, ternary oxide composite by techniques which can include cold pressing, isostatic pressing, extrusion, injection molding or slip casting. In an exemplary process disclosed in Carpenter, a ternary oxide composition of hafnia, titania, and zirconia is dispersed in water and mixed in a colloidal state and then formed into a disk shape by press filtering. The resulting composition is dried and crushed. An aqueous dispersion of the crushed particles are treated by sedimentation to recover particles of 1 micron or less. These particles are mixed with less than 1 micron size silicon nitride powder and suspended in an aqueous slurry along with alumina sintering aid and then press filtered to form a disk shaped sample. The resulting powder mixture is dried and sintered in air or nitrogen at 1700° C. to produce a silicon nitride composite of about 98% theoretical density.

DISCLOSURE OF THE INVENTION

The present invention provides a new and improved process for the formation of structures by isostatic compression and filtration. The invention involves the use of liquid dispersed powders of metals, ceramics and the like or their composite compositions which contain additional phases of particles, filaments or platelets to produce compression structures which may be of complicated shapes and which are suitable for further processing. In carrying out the invention, a mixture of particulate materials is established in a carrier liquid which may be an aqueous medium such as distilled water or a nonaqueous medium., e.g., an aliphatic alcohol such as isopropyl alcohol or a hydrocarbon solvent such as hexane or heptane. In a preferred application of the invention the particulate suspension materials comprise a mixture of colloidal ceramic powders and reinforcing filaments, e.g. silicon carbide whiskers, which impart desired physical characteristics to the composite. The suspension is incorporated into a die chamber having a filter opening therein fitted with a filter structure which is permeable to the carrier liquid but substantially impermeable to the particulate materials. The die chamber forms a mold surface of a desired configuration for the ceramic structure. An elevated pressure is isostaticly imposed on the colloidal suspension within the die chamber to dispel carrier liquid by filtration through the filter opening. The pressure is maintained for a period of time to expel at least 20% of the liquid originally contained in the colloidal suspension through the filter opening. The green composite may then be subjected to subsequent operations in order to arrive at the final ceramic structure.

Preferably, the total particulate solids content of the suspension incorporated into the die chamber is at least 20 volume %. In a preferred embodiment of the invention the die chamber comprises a rigid cage structure formed of a material enabling a transmission of pressure from the exterior to the interior of the cage structure. An expansible and conformable bladder is disposed within the cage structure and the suspension of particulate materials is incorporated into the interior of this bladder. Prior to adding the colloidal suspension into the bladder, a negative pressure gradient is established between the exterior of the cage structure and interior of the bladder. This causes the bladder to conform closely to the shape of the cage structure, enabling the production of a shaped green composite during the isostatic pressing operation having a smooth surface formed to close tolerances.

In a further aspect of the invention, there is provided an isostatic filtration press system for the formation of shaped ceramic wares or other shaped products. This system comprises a hollow pressure vessel provided with a first fluid passageway extending between the interior and exterior thereof. A rigid permeable cage structure is located within the interior of the pressure vessel. The cage structure has a first reduced portion of a configuration conforming to the desired shape of the ware product to be pressed within the system and an enlarged second portion defining an expansion chamber. A filter opening is formed in the reduced portion of the cage structure and in fluid communication with a second fluid passageway extending from the interior of the cage structure to the exterior of the pressure vessel. Thus, fluid expelled from the interior of the cage structure through the filter opening is passed to the exterior of the pressure vessel. The system further comprises means for securing an expansible bladder within a cage structure in a manner such that when the bladder is in place within the cage structure, the interior of the bladder is in fluid communication with the filter opening.

DETAILED DESCRIPTION OF THE INVENTION

Figure 1:
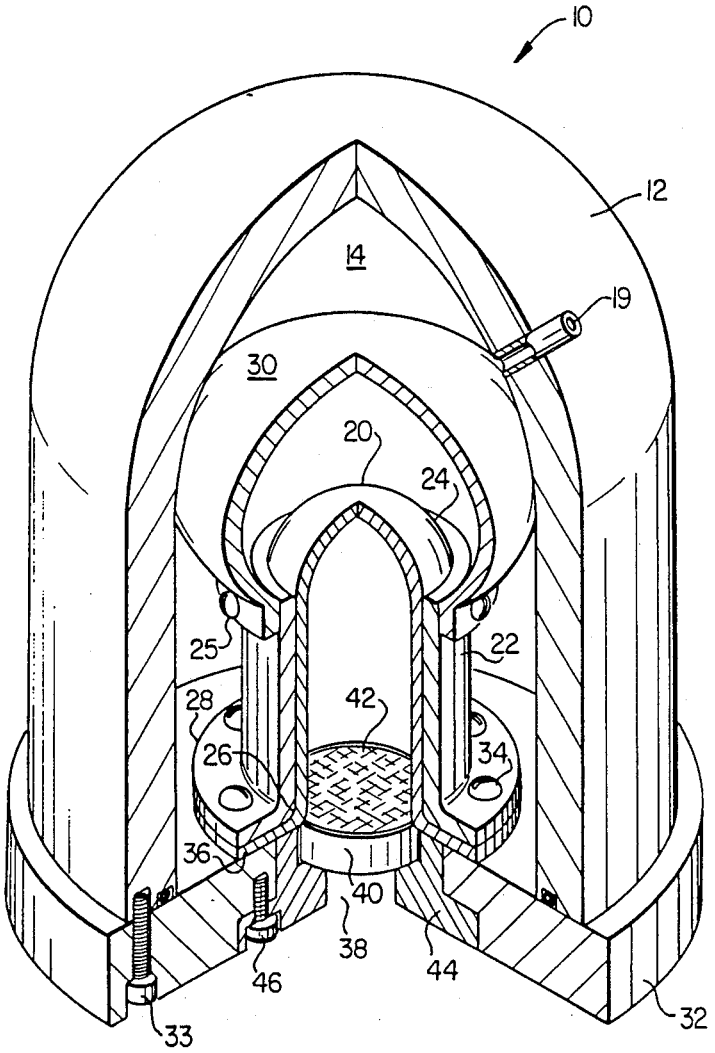
FIG. 1 is a perspective view with parts broken away and in section illustrating an isostatic filtration press in accordance with one embodiment of the invention.

As disclosed in the aforementioned patents to Bergman, Wei, Hunold, Carpenter and Nishio there are various refractory powders which may be employed as matrix materials in shaped high performance structures and such materials may be employed in formulating shaped green bodies in accordance with the present invention. Other suitable multicomponent composite particulate systems are disclosed in U.S. Pat. No. 3,833,389 to Komeya et al and U.S. Pat. No. 4,507,224 to Toibana et al. The invention can be employed in the formation of monolithic green structures based upon refractory matrix powders which may be metallic, ceramic or mixtures thereof as described previously. However, the invention is especially useful in forming composite structures to include reinforcing filaments in addition to the matrix powders and the invention will be described in detail with respect to this application. The invention is particularly applicable to the formation of green composite bodies which can then be subjected to sintering to provide high density, high performance composite structures. Refractory powder materials particularly useful in the formation of such structures include alumina, aluminum nitride, silicon nitride, silicon dioxide, magnesium dioxide and zironium dioxide, with silicon nitride being especially preferred. Where monolithic structures are to be formed, other suitable refractory materials include hafnium dioxide, silicon carbide and beryllium oxide.

It is well known in the art that reinforcing filaments can be embedded into the refractory matrix material to strengthen the composite structures and increase their resistance to such factors as abrasive and thermal stresses. The use of such reinforcing filaments to impart desired characteristics to the composites are disclosed in Kirk-Othmer—Encyclopedia of Chemical Technology, Third Edition, John Wiley & Sons, 1979, Refractory Matrix Powders, Volume 6, "Composite Materials" pages 683–700. In the case of high performance ceramic composites, monocrystalline whiskers are the reinforcing filaments of choice since they are not subject to the recrystallization or crystal breakdown reactions associated with polycrystalline or amorphous fibers at the processing temperatures involved. High performance whiskers include those formulated from silicon carbide, silicon nitride, magnesium oxide, aluminum oxide, boron carbide and various other materials which are well known to those skilled in the art.

While the invention is of broad application in the formation of filament reinforced powder composites, it is especially useful in forming green silicon carbide reinforced silicon nitride composite structures which are of the high density, high performance type; the production processes of which have heretofore involved high pressure autoclave equipment. Accordingly, the invention will be described, in detail, with respect to the preferred embodiment in which green silicon carbide reinforced silicon nitride composites having isotropic whisker orientation are formed. The shaped composites can then be sintered to arrive at the final product.

In addition to the ceramic matrix forming and reinforcing materials, the particulate composite can also contain a sintering aid component. The use of sintering aids is well known in the art, as evidenced, for example by the aforementioned patents to Komeya et al and Toibana et al. Sintering may or may not involve a melting reaction. In liquid-phase sintering as disclosed in Pat. No. 4,652,413 to Tiegs and also in Kirk-Othmer, Vol. 19, pages 28–46, under the heading "Powder Metallurgy", a transitional melt phase is formed between the solid particulate ceramic surfaces which, upon cooling, results in a relatively high density product. Stated otherwise, the liquid transitional melt phase promotes densifications of the composite materials. The liquid melt phase forms as a result of reduced melting point systems which can be analogized to eutectic forming alloy systems.

In carrying out the process of the present invention, a colloidal suspension of matrix particulates preferably together with reinforcing filaments is formed in a suitable carrier liquid. By the term colloidal suspension as used herein is meant a liquid dispersion of particulates which is between a true molecular solution on the low end (in terms of particle size) and a mechanical suspension where significant sedimentation due to gravity would occur during the isostatic compression process, on the high end. While characterization of the colloidal state in terms simply of particulate size is somewhat arbitrary, it is generally accepted in the art, that colloids include the millimicron to micron size range for at least one significant particle dimension. As a practical matter, the present invention is applicable to systems in which the matrix particles are no greater than about 5 microns and preferably no greater than 1 micron, as will appear hereinafter. In the preparation of a silicon carbide reinforced silicon nitride green composites, sintering aids useful in liquid-phase sintering are preferred. Such sintering aids include colloids selected from the group consisting of yttria, alumina, magnesia, ceria, silica, zirconia and mixtures thereof. An especially suitable sintering aid is a mixture of yttria and alumina in which the yttria is present in an amount greater than the alumina. Other preferred sintering aids include mixtures of magnesia, silica and yttria, with the alumina being present as a minor component relative to the other sintering materials. The sintering aid preferably is present in an amount of at least 5 wt.% of the matrix composition. Where the sintering aid comprises yttria, e.g., a mixture of yttria and alumina, concentrations of at least 10% are preferred.

The carrier liquid may be an aqueous liquid, e.g., distilled water, or it may be a nonaqueous liquid such as ethanol, isopropyl alcohol, or a light hydrocarbon solvent such as hexane. Additives to increase the viscosity of the carrier liquid and enhance its ability to hold the particulates in suspension may be employed but usually will be unnecessary particularly where in forming green composites for high density ceramics, the matrix materials such as silicon nitride powder and the sintering aid material are truncated to eliminate particles which are greater than one micron. It is, however, highly desirable to incorporate a dispersing agent, typically an anionic surfactant, into the carrier liquid in order to facilitate dispersion of the particulate materials without agglomeration. While it is particularly important to ensure that the silicon carbide whiskers are well dispersed, such agents also aid in facilitating dispersion of the silicon nitride powder and the sintering aid material. The dispersing agent may be added to the carrier liquid prior to the particulates or it may be mixed with the particulates and added to the carrier liquid concomitantly with the particulate materials.

Suitable surface active agents for use as dispersants in nonaqueous liquids such as alcohols and the like include Tamol 731, a sodium salt of a polymeric carboxyalic acid, available from Rhom & Haas Co. A suitable surface active agent for use in an aqueous liquid is Darvan C, an ammonium of a carboxylated liquid polyelectrolyte available from R. T. Vanderbilt Co.

In the preferred application of forming green composites of silicon nitride and silicon carbide, it is desirable to use a nonaqueous carrier liquid in order to avoid modification of the silicon nitride surfaces to produce silicon surfaces through interaction with water. If water is used, the isostatic compression procedure should take place immediately after formation of the suspension.

Commercial silicon nitride powder and sintering aid powders of magnesia, yttria, silica, alumina and the like in which the particulates are predominantly in the colloidal size range are readily available. Often such materials will contain minor amounts, typically within the range of 10–20%, of granules of sizes greater than 1 micron. Preferably, these commercially available materials are classified to remove and discard particle sizes greater than one micron. The amount of sintering aid material employed normally is about 5–15 wt.% expressed as a percentage of the matrix materials.

The amount of silicon carbide whiskers employed in the particulate mixture is determined by the average aspect ratio (the ratio of the whisker length to the whisker diameter) of the whiskers. In general, the maximum amount of reinforcing whiskers which can be incorporated into the particulate mixture, while still arriving at a product of the requisite high density, decreases as the aspect ratio increases. This relationship is described in detail in applicant's application Ser. No. 082,433 entitled "Method for the Production of Reinforced Composites" filed on even date herewith and further identified by attorneys docket no. B24076. As described there, if the mean whisker aspect ratio is 50, no more than 10 volume percent whiskers can be incorporated into the particulates. If the aspect ratio is reduced to 30, up to 20 volume percent whiskers can be incorporated. Preferably the average aspect value of the ratio of the whiskers is no greater than 30 and more desirably no greater than 20 in order to provide for the incorporation of substantial quantities of reinforcing whiskers into the composites.

Commerically available silicon whiskers sometimes have aspect ratios substantially above those called for in the preferred embodiment of the present invention. In order to reduce the average aspect ratio, the silicon carbide whiskers may be subjected to a ball milling operation in order to arrive at a reduced whisker length providing the desired aspect ratio. Even where the available whiskers have an aspect ratio in the range of 20–30, ball milling is still desirable in order to remove whisker "nests." It is also preferred that the silicon nitride and sintering aid matrix powders are classified so that the maximum particle size is no greater than the average silicon carbide whisker diameter. Thus where the average whisker diameter is about one micron, classification as described above to remove particles of greater than one micron is adequate. However where smaller diameter whiskers are employed, e.g. 0.5 microns it will be preferred to classify the matrix powders in order to remove particles of those materials having a size greater than 0.5 microns.

The particulates preferably are added to the carrier liquid in an amount of at least 20 volume % in order to reduce segregation of the reinforcing whiskers and matrix powders during the isostatic compression operation. More desirably, the colloidal suspension comprises at least 30 volume percent particulates and greater amounts of particulates can be advantageously employed so long as the rheology of the suspension is consistent with flowing the suspension into the isostatic compression chamber where it is shaped and colloidal filtration takes place. That is, the quantity of particulates should be limited so the suspension does not reach the point where it becomes so "stiff" that it is not flowable. This limit will vary depending upon the nature of the particulates and the carrier liquid, dispersing agent used and viscosity enhancers, if any, employed in the carrier liquid. As a practical matter, it usually will be desirable to provide that the carrier liquid itself forms at least 50 volume percent of the suspension i.e. the solids content is no more than 50 volume percent. Where reinforcing filament such as silicon carbide whiskers are present in the colloidal suspension, the solids content influence the orientation of the whiskers at the conclusion of the isostatic compression procedure. The greater the solids content, the greater the tendency for retention during the filtration process of the isotropy formed during the blending procedure. Particulate contents of 40% or more can usually be achieved without adversely affecting the rheology of the suspension and at this content, complete retention of the isotropy is assured. As a practical matter, a solids content of at least 30 volume percent will result in a satisfactory isotropic orientation of the whiskers. At the 20 volume percent particulate level, a directional whisker orientation along the filter axis may appear. This will become progressively more pronounced as the particulates content is reduced below the 20 percent volume.

The colloidal suspension of particulate materials is shaped to the desired configuration and subjected to colloidal filtration under isostatic pressure. FIG. 1 is a partially sectioned perspective illustration of an isostatic filtration press suitable for forming green ceramic composites of a solid cylindrical configuration and having random (isotropic) whisker orientation, as contrasted with unidirectional whisker orientation. More particularly and as shown in FIG. 1, the isostatic compression system 10 comprises a hollow pressure vessel 12, the interior of which provides an isostatic pressing chamber 14. A conduit 19 provides a fluid passageway extending between the interior and exterior of pressure vessel 12 which provides for the introduction and withdrawal of fluid to the isostatic pressure chamber 14. A die chamber of the desired configuration, in this case cylindrical, is provided by an elastic conformable bladder 20 which is in place within a rigid cage structure 22 formed of a material enabling the transmission of pressure from the exterior to the interior thereof. By way of example the cage 22 may be formed of a fluid permeable material such as wire mesh or it may be may take the form of a metal cylinder provided with a multitude of perforations through the wall thereof. The cylindrical cage 22 is open at the top and bottom ends 24 and 26 respectively. The bottom end of the cylinder cage 22 terminates in an external annular rim or shoulder 28 which provides a bolting plate to secure the bladder in place, as described below. An enlarged vessel 30, which like cylinder 22 is formed of a material enabling the transmission of pressure from the exterior to the interior thereof, fits over the top end 24 of the cylindrical cage 22 to provide an expansion chamber. Vessel 30 is secured to the cylindrical cage 22 by means of bolts 25.

The bolting plate 28 is secured to a bottom cover plate 32 by any suitable means such as bolts 34 and the conforming surfaces of plates 28 and 32 provide a means for securing the expansible bladder within the cage structure. The bladder 20 is provided with a flared annular rim section 36 which is circumferentially inserted between the plates 28 and 32 to hold the bladder securely in place. The bottom plate 32 is provided with a passageway 38 through which fluid may be expelled from the interior of the cage structure to the exterior of the pressure vessel 12. The bottom cover 32 is secured to the vessel 12 by any suitable means such as peripherally located bolts 33.

The open bottom end of the cage structure defines a filter opening in which a filter structure 40 is located and held in place by a shoulder formed in a filter stand 44. Filter stand 44 is attached to the cover plate 32 by means of bolts 46. The filter structure 40 may be of any suitable type but typically will take the form of a semipermeable membrane supported on a suitable permeable support structure such as a metal screen 42 which is capable of withstanding the pressure imposed upon the colloidal suspension within the bladder 20. The semipermeable membrane is permeable to the carrier liquid used in forming the colloidal suspension but is substantially impermeable to the colloidal matrix powders and the silicon carbide whiskers or other reinforcing filaments. A suitable semipermeable membrane may be formed of filter paper having interstitial pores ranging from about 100 to several hundred angstroms in diameter.

In operation of the system shown in FIG. 1, the bladder 20 is assembled in place within the cage structure and a negative pressure gradient is established between the chamber 14 and the interior of the bladder by evacuating the chamber 14 to provide a vacuum of sufficient pressure to draw the bladder to conform to the permeable cage, but not draw the bladder into the pores of the cage, so as to cause damage to the bladder. The passageway 19 is connected to a suitable vacuum pump (not shown) for this purpose. The negative pressure gradient established across the cage structure is sufficient to cause the bladder 20 to conform to the interior surface of cylinder 22. The bladder is also expanded sufficiently to conform to the internal surface of the vessel 30 defining the expansion chamber The expansion chamber is of sufficient volume so that total amount of colloidal suspension within the cage structure will be adequate to accommodate the expulsion of liquid during the isostatic compression process to arrive at the desired volume of the green composite within the cylindrical cage structure 22.

With the compression press 10 inverted, the carrier liquid containing the colloidal size ceramic powders and reinforcing filaments is poured through opening 38 into the expanded bladder. After the bladder is filled the filter structure 40 is inserted into place and filter stand 44 is secured to plate 32. The vacuum is released through port 19 and a pressurizing fluid is pumped via passageway 19 into the isostatic compression chamber 14. While pressurization can take place pneumatically, it will be preferred to pump a liquid into chamber 14 in order to provide for close control of the isostatic compression process.

The isostatically imposed pressure is maintained at a level, preferably within the range of 1000–5000 psig for a time sufficient to expel sufficient liquid through the filter opening to compress the colloidal suspension to arrive at a green composite conforming generally to the shape and volume of the cylindrical cage structure 22. The amount of liquid expelled through the filter opening will depend upon the liquid and solids content of the original colloidal suspension. Where the suspension contains at least 20 volume percent particulates, as is preferred as noted above, usually at least 40% of liquid will be removed during the isostatic compression and filtration process. Where greater concentrations of particulates are employed, correspondingly reduced amounts of liquid normally will be expelled. As a practical matter it will be preferred to expel at least 20% of the liquid originally contained in the colloidal suspension through the filter opening. In the preferred application of the invention in arriving at green silicon nitride silicon carbide whisker reinforced composites, sufficient liquid is expelled to arrive at a form density of the green composite of at least 40% and preferably of at least 45 or 50 percent and of theoretical density.

The isostatic filtration pressure and the duration during which it is imposed will vary depending upon the initial particulates content of the suspension, the nature of the particulates, and the nature of the carrier liquid. As noted above, the pressure imposed upon the suspension within the bladder normally be within the range of 1000–5000 psig. The filtration time will be within the range of 30–120 minutes. In any case, the pressures used can be well below those normally encountered in dry pressing techniques since the carrier liquid acts as a "lubricant" between the solid particulates, aiding in compaction. Conventional isostatic pressing operations normally require pressures on the order of 30,000 to 100,000 higher. While lower pressures ranging down to about 10,000 psig have been proposed, these lower pressures normally do not provide for sufficient compaction during the pressing technique. In the present invention, pressure less than 10,000 psig are desirable in the production of the whisker reinforced ceramic products in order to avoid imparting whisker damage which is sometimes associated with the high pressures employed in dry pressing operations. Accordingly it is highly desirable to carry out the colloidal filtration step at a pressures less than the 10,000 psig minimum associated with the prior art practices and as a practical matter the pressure should be less than 7000 psig.

The isostatic compression and filtration operation may be described as a "cold" isostatic pressing operation since it normally will be carried out under ambient temperature conditions. In some cases it may be desirable to employ modestly elevated temperatures, for example, to reduce the viscosity of the carrier liquid during the filtration process, but the temperature will in any event be below the boiling point of the carrier liquid. The procedure cannot in any sense be characterized as a hot isostatic pressing operation.

At the conclusion of the isostatic compression process the filter assembly 40, 44 is removed and the green composite then removed from the assembly 10. The green composite, while it still contains a substantial liquid content, normally within the range of 30–50 volume percent, is sufficiently compacted to be self sustaining in the shaped configuration and can be readily machined as necessary at this point prior to further processing. In the case of the cylindrical configuration shown in FIG. 1 very little or no machining will be required on the cylindrical outer surface. The top portion of the composite will usually require a minor amount of machining. The bottom portion which is next to the filter paper may require machining but usually will not.

After such machining as is necessary, the green composite can then be subjected to additional operations which normally will include drying, heating to a temperature sufficient to thermally decompose the dispersion agent used if any, and finally sintering to arrive at the final product. For a further description of such operations in forming high density ceramic composites, reference is made to the applicant's aforementioned application Ser. No. 082,433 entitled "Method for the Production of Reinforced Composites" filed on even date herewith, the entire disclosure of which is incorporated herein by reference.

Figure 2:
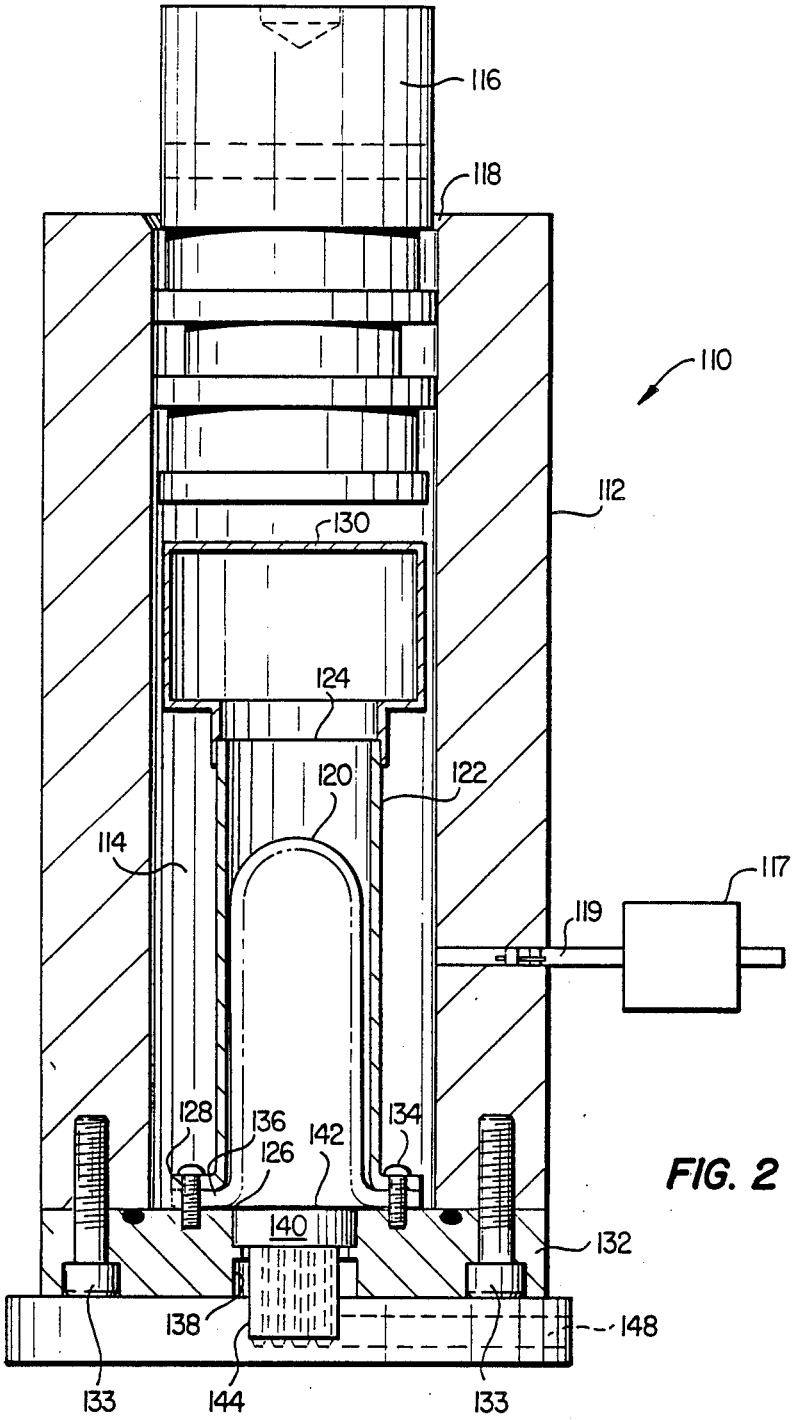
FIG. 2 is a side elevational view partly in section of another embodiment of the present invention.

Turning now to FIG. 2, there is illustrated another embodiment of the present invention which, like the embodiment of FIG. 1, is employed to arrive at a green composite of a solid cylindrical configuration. As shown in FIG. 2, the modified form of isostatic filtration press 110 comprises a metallic cylinder 112 the interior of which provides an isostatic pressing chamber 114. The interior of the cylinder is open at the top end 118 and receives a piston 116. Line 119 is secured to a port extending through the wall of the cylinder and comprises a high pressure valve 117 which may be connected alternatively to a vacuum pump. The system further comprises a permeable bladder cage 122 which is open at its top and bottom ends 124 and 126 respectively and contains an expansible bladder 120.

A bolting plate 128 is secured to the bottom of cylinder 122 and an enlarged vessel 130 is secured to the top of the cylinder and provides an expansion chamber. The bolting plate 128 is secured to the bottom cover 132 by bolts 134. The conforming surfaces of these elements function to hold the bladder 120 in position by means of an annular rim 136 of the bladder similarly as described above with reference to FIG. 1. The bottom cover is secured to the cylinder by bolts 133 and has a central passageway 138 which opens into fluid communication with the interior of the bladder. A filter structure comprising a metallic filter support 140 and a semipermeable membrane 142 allows carrier fluid to be dispelled from the bladder similarly as described by with respect to FIG. 1. The filter structure is secured in place by a filter stand 144 having channels therein which allow fluid flowing through the filter to pass into a passageway 148 in a pressing plate 146.

In operation the system shown in FIG. 2, the conduit 119 is placed in communication with a vacuum pump through valve 117 causing the bladder to expand into conformance with the cage structure. The colloidal suspension described above is placed into the bladder and the filter elements 140 and 142 are placed in position and the press is then assembled. The vacuum is released and the valve 117 is closed. A suitable source of compressing liquid is placed into the interior chamber 114 and the piston 116 then inserted. As the piston is initially inserted into the top of the cylinder 112, valve 117 is opened sufficiently to bleed off air and excess pressurizing fluid from the interior of the chamber. The valve is then closed. In this embodiment, the isostatic compressing pressure is imposed by placing the assembly into a vice or press mechanism and forcing the piston inwardly until the desired pressure is reached. Once sufficient liquid is dispelled to arrive at the desired green composite, the press is disassembled and the green composite is removed, machined as necessary and made available for further processing.

The embodiment of FIG. 2 offers the advantage of not requiring high pressure pumping equipment. Thus, the liquid, can be loaded into the chamber 114 at atmospheric or near atmospheric pressure and the desired pressure, again preferably within the range of 1000–5000 psig, imposed simply by placing the necessary mechanical force on the top of piston 116 and the bottom of plate 146.

Figure 3:
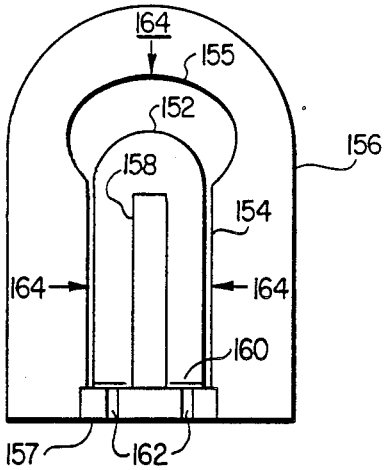
FIG. 3 is a schematic illustration of another embodiment of the invention used to form a hollow composite structure by isostatic compression and filtration.

The invention can be employed to form hollow as well as solid green composites by appropriate modification of an isostatic pressing mechanism such as shown in FIGS. 1 or 2. For example FIG. 3 shows a schematic illustration of a system, similar to those described above to form a solid cylindrical object, but which is modified to form a hollow cylinder. In the system depicted in FIG. 3, only the permeable cage structure, bladder, filter support structure, and pressure vessel are illustrated. As shown in FIG. 3, a bladder 152 is imposed within a bladder cage 154 having an expansion chamber 155 formed on the upper end thereof and located within pressure vessel 156. In this case, the filter support 157 includes a solid cylindrical mandrel 158 which extends upwardly into the cage and is concentrically disposed therewith. A semipermeable filter membrane 160 fits into the bottom of the bladder cage in the annular space between the mandrel and the cage. Fluid is dispelled through passages 162. The operation of the system shown in FIG. 3 is similarly as described above with the exception that the amount of colloidal suspension introduced into the bladder after imposition of the negative pressure gradient will be reduced by the volume of the mandrel member 158. Suitable pressure is developed within the pressure vessel 156 to isostatically compress the colloidal suspension as indicated by arrows 164.

Figure 4:
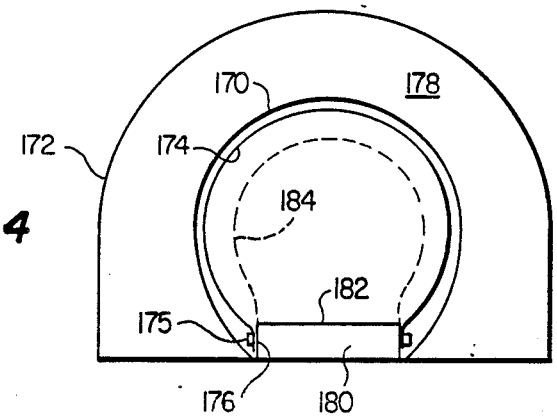
FIG. 4 is a schematic illustration of yet another embodiment of the invention used to form a spherical composite structure.

Use of an expansion chamber as described above is particularly advantageous where colloidal suspensions of relatively low solids content are employed. In some cases the expansion chamber may be dispensed with. This is especially so where the solids content of the colloidal suspension is at least 40 volume percent. In this case, the reduction in volume necessary to achieve the green composite is of a relatively low magnitude so that the green composite very closely conforms to the configuration of the original bladder cage notwithstanding that the composite is of somewhat smaller dimensions. This embodiment of the invention is shown schematically in FIG. 4 which illustrates a device suitable for preparation of a solid generally spherical object. In FIG. 4, the isostatic compression press comprises a spherical bladder cage 170 located within a pressure vessel 172. An expansible bladder 174 is secured within the bladder cage by means of an annular clamp 175 around an upstanding filter support 176. In operation of the system shown in FIG. 4, the compression chamber 172 is evacuated as described previously, causing the bladder to conform to the inner surfaces of bladder cage 170. The bladder is then filled with colloidal suspension and a filter structure 180 including a semipermeable membrane 182 is locked in place. The pressure vessel 172 is then filled with a suitable liquid medium and pressurized to isostatically compress the bladder until it reaches a configuration as indicated by the broken line 184. The green composite can then be removed from the disassembled apparatus, machined as necessary, and subjected to further drying and sintering procedures.

While the invention has been described in the formation of simple shapes it can also be employed in producing green composites of more complex shapes. It is, in any event, especially useful in the formation of three dimensional products through the use of an appropriately shaped cage structure. The cage structure will have a substantial three dimensional configuration in which the filter length, i.e., the dimension of the cage structure generally normal to the filter is greater than 25%, and more preferably greater than 50%, of the width of the cage structure. Thus, by way of reference to the spherical structure shown in FIG. 4, the filter length and the width of the cage structure have substantially the same values. In the case of a cylindrical structure, the filter length would be measured along the axis of the cylinder and the width of the cage structure would correspond to the diameter of the cylinder. For complex shapes, average values would be employed in calculating the filter length.

Having described specific embodiments of the present invention, it will be understood that modification thereof may be suggested to those skilled in the art, and it is intended to cover all such modifications as fall within the scope of the appended claims.

I claim:

1. In an isostatic compression process for forming compression structures, the steps comprising:

(a) establishing a suspension of colloidal size matrix powders in a carrier liquid;

(b) providing a die chamber comprising a self-supporting cage structure formed of material enabling the transmission of pressure from the exterior to the interior thereof and an expansible and conformable bladder within said cage structure, said die chamber having a filter opening and a filter disposed therein which is permeable to filtrate from said colloidal suspension under an applied pressure but substantially impermeable to said matrix powders;

(c) incorporating said colloidal suspension into the interior of said bladder; and (d) isostatically imposing an elevated pressure on said bladder containing said colloidal suspension within said die chamber at a pressure sufficient to dispel carrier liquid filtrate through said filter opening and maintaining said pressure for period sufficient to expel at least 20% of the liquid originally contained in said colloidal suspension through said filter opening.

2. The method of claim 1 wherein said suspension contains filament elements in said carrier liquid in admixture with said matrix powders.

3. The method of claim 1 wherein the total suspended solids content of said suspension incorporated into said die chamber is at least 20 volume percent.

4. The method of claim 3 wherein said total suspended solids content is at least 30 volume %.

5. The method of claim 1 wherein said elevated pressure is imposed on said die chamber by imposing a pressure on liquid surrounding at least a substantial portion of said chamber.

6. The method of claim 1 further comprising the step of, prior to incorporating said colloidal suspension into said bladder, establishing a negative pressure gradient between the exterior of said cage structure and the interior of said bladder to cause said bladder to conform to the shape of at least a portion of said cage structure.

7. The method of claim 6 wherein said negative pressure gradient is established by establishing a vacuum in a compression chamber surrounding said cage structure and, after said suspension is incorporated into the interior of said bladder, releasing said vacuum and isostatically imposing said elevated pressure by introducing a pressurizing fluid into said compression chamber.

8. The method of claim 7 wherein said pressurizing fluid is a liquid.

9. The method of claim 1 wherein said die chamber has an enlarged portion defining an expansion chamber and a reduced portion of a configuration conforming to a desired shape of said composite structure and further comprising the step of initially incorporating a sufficient amount of said suspension into said die chamber to cause said suspension to enter into said expansion chamber and upon the imposition of said isostatic pressure forcing at least a portion of the colloidal suspension in said expansion chamber from said expansion chamber into said reduced die chamber section.

10. The method of claim 1 wherein said die chamber has a substantial three dimensional configuration and the filter length of said die chamber along an axis normal to said filter opening is greater than 25% of the width of said die chamber.

11. In an isostatic compression process for forming a reinforced green composite structure in a self sustaining shaped configuration suitable for sintering, the steps comprising:

(a) establishing a suspension of colloidal size refractory matrix powders and refractory reinforcing whiskers in a carrier liquid;

(b) providing a die chamber comprising a self-supporting cage structure formed of material enabling the transmission of pressure from the exterior thereof and an expansible and conformable bladder within said cage structure, said die chamber having a filter opening and a filter disposed therein which is permeable to filtrate from said colloidal suspension under an applied pressure but substantially impermeable to said refractory ceramic powder;

(c) incorporating said suspension into the interior of said bladder; and (d) isostatically imposing an elevated pressure on said bladder containing said colloidal suspension within said die chamber at a pressure sufficient to dispel carrier liquid filtrate through said filter opening and maintaining said pressure for period sufficient to expel at least 20% of the liquid originally contained in said colloidal suspension through said filter opening to arrive at a green composite structure capable of retaining its configuration upon removal from said die chamber.

12. The method of claim 11 wherein the total suspended solids content of said suspension incorporated into said die chamber is at least 20 volume percent.

13. The method of claim 11 wherein said total suspended solids content is at least 30 volume %.

14. The method of claim 11 wherein said elevated isostatic pressure is less than 10,000 psig.

15. The method of claim 14 wherein said elevated pressure is less than 7,000 psig.

16. The method of claim 15 wherein said elevated pressure is within the range of 1,000–5,000 psig.

17. The method of claim 11 wherein said colloidal size refractory powders are selected from the group consisting of aluminum oxide, aluminum nitride, silicon nitride, silicon dioxide, magnesium dioxide, zirconium dioxide and mixtures thereof.

18. The method of claim 17 wherein said refractory whiskers are selected from the group consisting of magnesium oxide, alumina, silicon carbide, silicon nitride, boron carbide and mixtures thereof.

19. The method of claim 18 wherein said refractory powders have a particle size no greater than 1 micron.

20. The method of claim 19 wherein said refractory whiskers have a diameter no greater than 1 micron.

21. The method of claim 20 wherein said elevated pressure is imposed on said die chamber by imposing a pressure on liquid surrounding at least a substantial portion of said chamber.

22. The method of claim 21 further comprising the step of, prior to incorporating said colloidal suspension into said bladder, establishing a negative pressure gradient between the interior of said bladder and the exterior of said cage structure to cause said bladder to conform to the shape of said cage structure.

23. The method of claim 22 wherein said negative pressure gradient is established by establishing a vacuum in a compression chamber surrounding said cage structure and, after said suspension is incorporated into the interior of said bladder, releasing said vacuum and isostatically imposing said elevated pressure by introducing a pressurizing fluid into said compression chamber.

24. The method of claim 20 wherein said colloidal size ceramic powder comprises silicon nitride and wherein said whiskers comprises silicon carbide.

25. The method of claim 11 wherein said die chamber has a substantial three dimensional configuration and the filter length of said chamber along an axis normal to said filter is greater than 25% of the width of said die chamber.

* * * * *